US006570473B2

(12) United States Patent
Endo et al.

(10) Patent No.: US 6,570,473 B2
(45) Date of Patent: May 27, 2003

(54) BAND PASS FILTER

(75) Inventors: Kenji Endo, Tokyo (JP); Osamu Takubo, Tokyo (JP)

(73) Assignee: TKD Corporation, Tokyo (JP)

( * ) Notice: Subject to any disclaimer, the term of this patent is extended or adjusted under 35 U.S.C. 154(b) by 0 days.

(21) Appl. No.: 09/940,071

(22) Filed: Aug. 27, 2001

(65) Prior Publication Data

US 2002/0039057 A1 Apr. 4, 2002

(30) Foreign Application Priority Data

Aug. 30, 2000 (JP) ..... 2000-261261

(51) Int. Cl.[7] ..... H01P 1/202
(52) U.S. Cl. ..... 333/206
(58) Field of Search ..... 333/134, 202, 333/206, 207, 222, 223

(56) References Cited

U.S. PATENT DOCUMENTS 4,703,291 A * 10/1987 Nishikawa et al. ..... 333/202
4,987,393 A * 1/1991 Yorita et al. ..... 333/202
5,150,089 A * 9/1992 Komazaki et al. ..... 333/206
5,157,365 A * 10/1992 Hoang ..... 333/206
5,170,141 A * 12/1992 Yamazaki et al. ..... 333/202
5,208,565 A * 5/1993 Sogo et al. ..... 333/206
5,239,280 A * 8/1993 Noguchi et al. ..... 333/202
5,764,118 A * 6/1998 Saito et al. ..... 333/206
6,052,040 A * 4/2000 Hino ..... 333/134

FOREIGN PATENT DOCUMENTS

JP 03173202 A * 7/1991
JP 05063406 A * 3/1993
JP 11027006 1/1999

* cited by examiner

*Primary Examiner*—Seungsook Ham
(74) *Attorney, Agent, or Firm*—Brown Raysman Millstein Felder & Steiner

(57) ABSTRACT

A band pass filter is constituted of a dielectric block 2 having through holes 5 formed from one surface to the opposite surface and a single layered dielectric plate 3 joined to the dielectric block 2 such that the back surface thereof faces the one surface of the dielectric block 2.

16 Claims, 11 Drawing Sheets

BAND PASS FILTER

BACKGROUND OF THE INVENTION

The present invention relates to a band pass filter, and particularly, to a compact band pass filter that can be fabricated at low cost.

DESCRIPTION OF THE PRIOR ART

In general, a dielectric block having through holes passing from one surface to the opposite surface and all of whose surfaces except said one surface are metallized is used as a band pass filter. The through holes formed on the dielectric block work as resonators for the high frequency signal. The band pass filter is formed by adding capacitance and so forth to the resonators.

Many proposals have been made regarding methods for adding capacitance and so forth to the resonators constituted by the through holes.

According to one such method the dielectric block with the through holes is mounted on a substrate and the capacitors etc. are added to the substrate as separate components to form the band pass filter circuit. This method has the advantage that complex processing of the dielectric block is not required but has the disadvantage that the overall circuit size is enlarged because numerous components are used. The method is therefore not suitable for application to equipment that requires miniaturization, such as mobile phones.

According to another proposed method, conductive patterns that work as capacitors etc. are formed on said one surface of the dielectric block by screen-printing to form the band pass filter circuit. This method has the advantage that overall circuit size can be reduced because no capacitors etc. are added as different components, but has the disadvantage that it is extremely difficult to form the conductive patterns. Specifically, although the dielectric block should be stood and fixed with said one surface facing upward in order to print the conductive patterns on said one surface of the dielectric block, this is a very unstable state because the dimensions of said one surface and the opposite surface are small compared with the other surfaces. Further, high patterning accuracy is required for forming the conductive patterns on said one surface of the dielectric block but it is very difficult to form the conductive patterns accurately by the screen-printing in such an unstable state. Moreover, in certain types of the band pass filters, said opposite surface of the dielectric block is not flat but has a step. In this case it is extremely difficult to make the dielectric block stand with said one surface facing upward. For this reason, it is difficult to form the conductive patterns on said one surface of the dielectric block accurately and the fabricating cost increases. Another problem is that it is difficult to obtain large capacitance etc. by only forming the conductive patterns which work as capacitors on said one surface of the dielectric block.

In still another method, grooves or cavities are formed on said one surface of the dielectric block to form the band pass filter circuit by intentional disruption of the electromagnetic field balance. Like the method explained earlier, this method has the advantage that overall circuit size can be reduced but has the disadvantage that it increases fabricating cost because the conductive pattern must be formed on said one surface having the grooves or cavities by screen-printing with the dielectric block maintained with said one surface facing upward.

In still another method, proposed in Japanese Patent Laid Open No. 11-27006, a multilayered circuit member is added to said one surface of the dielectric block. This method has the advantage that it is easy to fabricate the dielectric block because no special processing for forming conductive patterns, cavities or the like on the dielectric block is required but has the disadvantage of high fabricating cost because the fabrication of the multilayered circuit member is complex, i.e., it has to be fabricated by laminating a number of dielectric layers each having a predetermined conductive pattern and through holes.

As pointed out above, the conventional methods for adding the capacitance and so forth to the resonators formed by the dielectric block having through holes encounter such problems as that overall circuit size is enlarged owing to the formation of numerous components or that the fabricating cost increases because it is difficult to fabricate the dielectric block or the multilayered circuit member to be added thereon.

SUMMARY OF THE INVENTION

It is therefore an object of the present invention to provide a compact band pass filter that can be fabricated at low cost.

The above and other objects of the present invention can be accomplished by a band pass filter comprising a dielectric block having through holes formed from one surface thereof to another surface opposite the one surface and a single layered dielectric plate having a front surface and a back surface joined to the dielectric block such that the back surface faces the one surface of the dielectric block, the dielectric block having metallizations formed on all surfaces except the one surface, and the dielectric plate having metallizations of predetermined patterns formed on the front and the back surfaces.

According to the present invention, a compact band pass filter that can be fabricated at low cost can be provided because it is formed by joining the single layered dielectric plate to the dielectric block. Further, since it is not necessary to form metallization on the one surface of the dielectric block, the dielectric block can be formed easily. Moreover, since metallizing on the front and back surfaces of the dielectric plate can be preformed in a stable state, the dielectric plate can be also formed easily.

In a preferred aspect of the present invention, the metallizations formed on the front and the back surfaces of the dielectric plate respectively form the one electrodes and the other electrodes of capacitors.

According to this preferred aspect of the present invention, capacitance can be added easily to the dielectric block because the metallizations formed on the opposite surfaces of the single layered dielectric plate form a capacitor.

In a further preferred aspect of the present invention, the metallizations formed on the back surface of the dielectric plate are in contact with the metallizations formed on inner walls of the through holes.

In a further preferred aspect of the present invention, the dielectric plate has cavities formed on the back surface thereof and the metallizations are formed on inner walls of the cavities.

According to this preferred aspect of the present invention, because the cavities are formed on the back surface of the dielectric plate, various characteristic can be given to the band pass filter by varying the shape of the cavities. Further, in the case where capacitors are formed by the metallizations formed on the inner walls of the cavities and metallizations formed on the front surface of the dielectric plate, large capacitance can be obtained.

In a further preferred aspect of the present invention, the dielectric plate has metallized projections projecting from the cavities, the metallizations formed on the projections being in contact with the metallizations formed on inner walls of the through holes.

In a further preferred aspect of the present invention, the through holes include at least a first through hole and a second through hole, the metallizations formed on the front surface of the dielectric plate include at least a first pattern and a second pattern, and the metallizations formed on the back surface of the dielectric plate include at least a third pattern and a fourth pattern, a first capacitor being formed by the first and third patterns, a second capacitor being formed by the second and fourth patterns, and the third and fourth patterns being in contact with the metallizations formed on inner walls of the first and second through holes, respectively.

In a further preferred aspect of the present invention, the first and second patterns are an input terminal and an output terminal, respectively.

In a further preferred aspect of the present invention, the dielectric block and the dielectric plate are made from the same material.

In a further preferred aspect of the present invention, the dielectric block and the dielectric plate are fixed by solder.

In a further preferred aspect of the present invention, every metallization is made of a conductive paste, and the dielectric block and the dielectric plate are fixed by sintering the conductive paste with the dielectric block and the dielectric plate joined.

According to this preferred aspect of the present invention, because the dielectric block and the dielectric plate are fixed by sintering the conductive paste, no solder is required. Therefore, lead (Pb) free soldering that should be performed at higher temperature than ordinary can be applied when the band pass filter is mounted.

In a further preferred aspect of the present invention, the back surface of the dielectric plate has a different area from that of the one surface of the dielectric block.

BRIEF DESCRIPTION OF THE DRAWINGS

FIG. 1(*b*) is a perspective view showing the band pass filter 1 with its components joined.

FIG. 4(*b*) is a perspective view showing the band pass filter 16 with its components joined.

FIG. 7(*b*) is a perspective view showing the band pass filter 32 with its components joined.

FIG. 10(*b*) is a perspective view showing the band pass filter 48 with its components joined.

DESCRIPTION OF THE PREFERRED EMBODIMENTS

Preferred embodiments of the present invention will now be explained with reference to the drawings.

Figure 1:
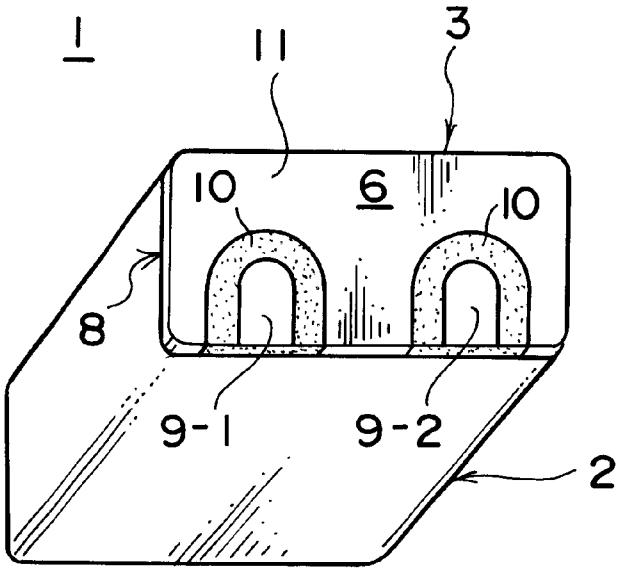
FIG. 1(*a*) is a perspective view showing a band pass filter 1 that is a preferred embodiment of the present invention with its components separated.
Figure 1:
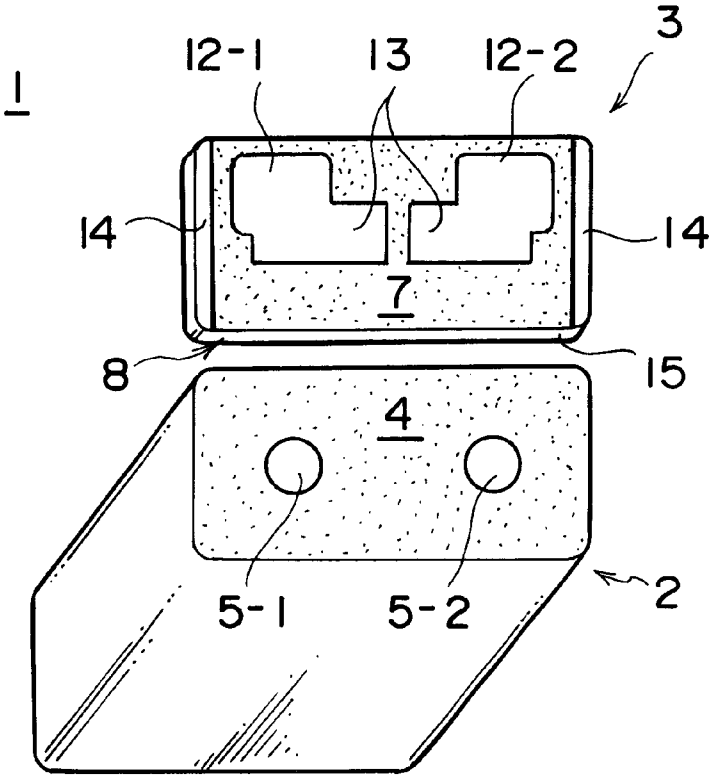

FIG. 1 is a perspective view showing a band pass filter 1 that is an embodiment of the present invention; FIG. 1(*a*) shows the components of the band pass filter in a separated state and FIG. 1(*b*) shows them in a joined state.

As shown in FIG. 1, the band pass filter 1 is constituted of a dielectric block 2 and a dielectric plate 3.

The dielectric block 2 has the shape of an almost rectangular prism measuring 6.0 mm×2.6 mm×8.8 mm and is made of a ceramic ($\epsilon r$=92) composed mainly of barium titanate. The dielectric block 2 has two through holes 5-1 and 5-2 that are formed in parallel from a surface 4 to the opposite surface (not shown). The through holes 5-1 and 5-2 are 1.2 mm in diameter. Further, all surfaces of the dielectric block 2 (including the inner walls of the through holes 5-1 and 5-2) except the surface 4 are metallized and are grounded during mounting. In FIG. 1, the metallized portions are shown in the color of the drawing sheet and the portion without metallization is speckled.

Figure 2:
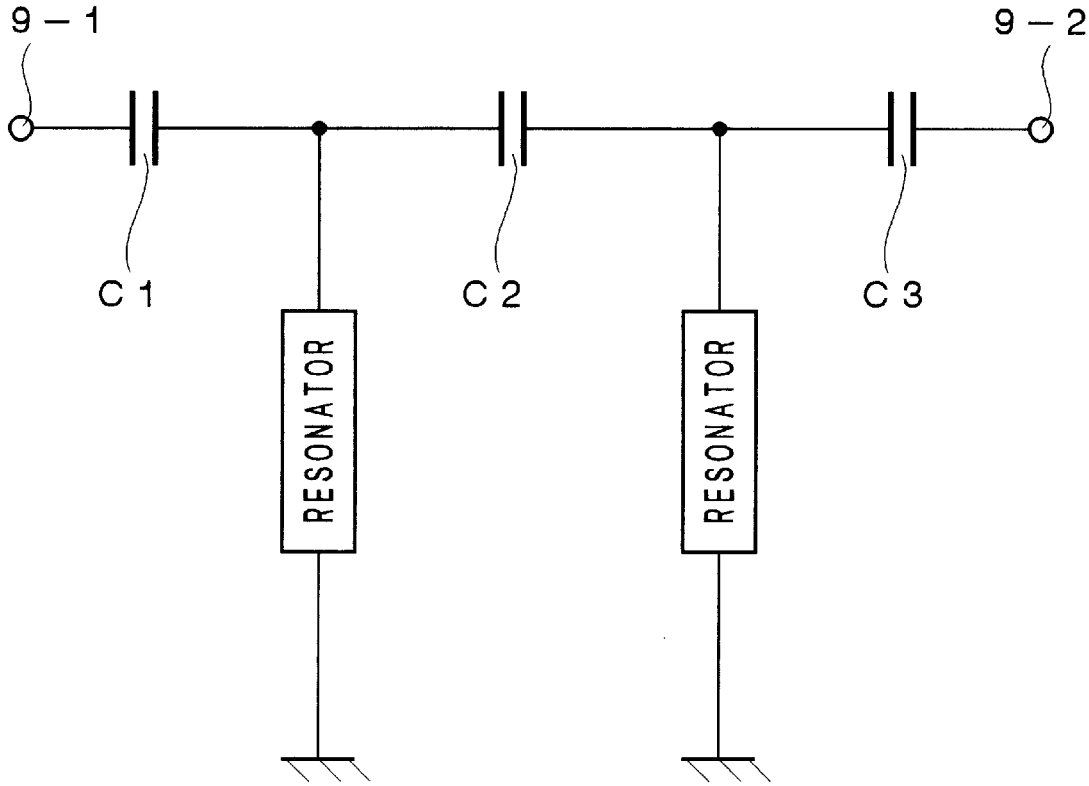
FIG. 2 is a circuit diagram of the band pass filter 1.

The dielectric plate 3 is a single layered plate measuring 6.0 mm×2.6 mm×0.8 mm made of ceramic ($\epsilon r$=92) composed mainly of barium titanate, the same material as the dielectric block 2. The dielectric plate 3 has a surface (front surface) 6 that faces outward when the dielectric plate 3 is joined to the dielectric block 2, a surface (back surface) 7 that faces toward the surface 4 of the dielectric block 2 when the dielectric plate 3 is joined to the dielectric block 2, and an edge surface 8. As shown in FIG. 1(*b*), metallizations 9-1 and 9-2 are formed on the front surface 6 at the portions to be input/output terminals and a metallization 11 is formed on the entire front surface 6 except at clearance portions 10 located at the peripheries of the metallizations 9-1 and 9-2. As shown in FIG. 1(*a*), metallizations 12-1 and 12-2 are formed on the back surface 7 at the portions corresponding to the two through holes 5-1 and 5-2. When the dielectric plate 3 is joined to the dielectric block 2, the metallizations 12-1 and 12-2 are directly in contact with the metallizations formed on the inner walls of the through holes 5-1 and 5-2, respectively. The metallizations 12-1 and 12-2 face the metallizations 9-1 and 9-2, respectively, formed on the front surface 6 of the dielectric plate 3 so as to form capacitors C1 and C3 (FIG. 2). The metallizations 12-1 and 12-2 have portions proximate to each other (proximate portions) 13 so as to form a capacitor C2. Further, as shown in FIG. 1(*a*), metallizations 14 whose widths are 0.8 mm are formed on parts of the periphery of the back surface 7 of the dielectric plate 3. As shown in FIG. 1(*b*), metallizations 15 are formed on the whole of the edge surface 8 except at portions in contact with the metallizations 9-1 and 9-2 and the clearance portions 10.

The dielectric plate 3 having the above described structure is attached to the dielectric block 2 with its back surface 7 facing the surface 4 of the dielectric block 2, and in this state, solder (not shown) is applied at the interface between the metallizations formed on the dielectric block 2 and the metallizations formed on the dielectric plate 3 to complete the band pass filter 1 of this embodiment. Thus, the metallizations formed on the dielectric block 2 are connected to the metallization 11 formed on the front surface 6 of the dielectric plate 3 through the metallizations 14 formed on the back surface 7 of the dielectric plate 3 and the metallizations 15 formed on the edge surface 8 of the dielectric plate 3. As mentioned above, the metallizations 12-1 and 12-2 are in contact with the metallizations formed on the inner walls of the through holes 5-1 and 5-2, respectively.

These metallizations provided on the dielectric block 2 and the dielectric plate 3 are formed of silver paste to a prescribed thickness.

FIG. 2 is a circuit diagram of the band pass filter 1.

As shown in FIG. 2, the band pass filter 1 is constituted of the capacitors C1 to C3 connected in series between the metallizations 9-1 and 9-2, which are the input/output terminals, and resonators each connected between the nodes of the capacitors C1 and C2 and the capacitors C2 and C3 and the ground. One of the metallizations 9-1 and 9-2 is used as the input terminal and the other is used as the output terminal. The two resonators are realized by the metallizations formed on the inner walls of the through holes 5.

Figure 3:
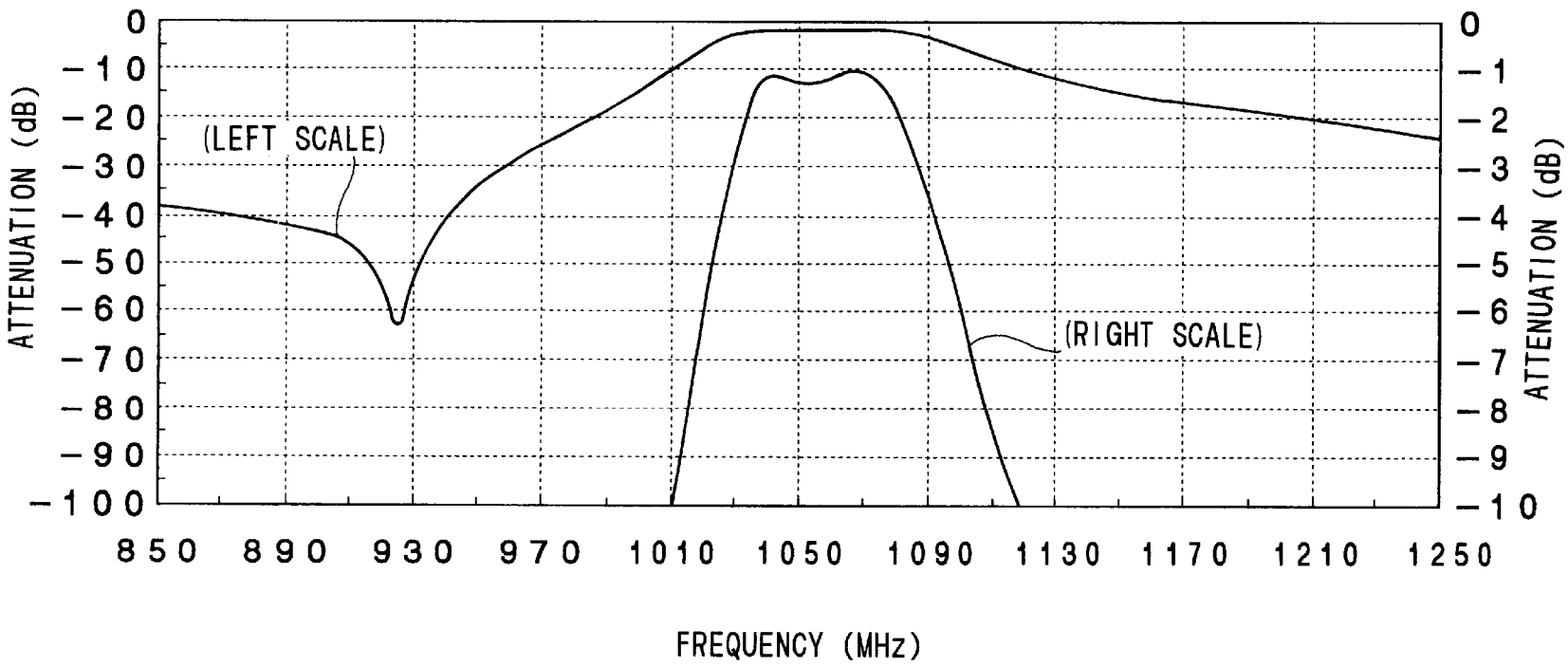
FIG. 3 is a graph showing the frequency characteristic curve of the band pass filter 1.

FIG. 3 is a graph showing the frequency characteristic curve of the band pass filter 1.

As shown in FIG. 3, the band pass filter 1 has a characteristic of passing a high frequency signal of approximately 1030 MHz to 1080 MHz and effectively eliminating a high frequency signal of approximately 910 MHz to 940 MHz. Therefore, the band pass filter 1 of this embodiment can be used as a component requiring such a frequency characteristic.

The frequency characteristic of the band pass filter 1 depends on the shape (length in particular) of the dielectric block 2 and the pattern of the metallizations formed on the dielectric plate 3. Thus, a desired frequency characteristic can be given to the band pass filter 1 by varying the shape of the dielectric block 2 and the pattern of the metallizations formed on the dielectric plate 3.

A method of fabricating the band pass filter 1 of this embodiment will now be explained.

First, the main bodies of the dielectric block 2 and dielectric plate 3 are formed by press molding and sintering ceramic powder including barium titanate as main component. When the dielectric block 2 is formed, two rods are disposed where the through holes 5 are to be formed during press molding in order to form the block with two through holes and the block is then sintered. By this, the main body of the dielectric block 2 is formed to measure 6.0 mm×2.6 mm×8.8 mm. The dimensions of the dielectric plate 3 formed by press molding and sintering are 6.0 mm×2.6 mm×0.8 mm.

Next, the metallizations are applied to the entire inner walls of the through holes 5 of the main body of the dielectric block 2 by introducing an Ag (silver) paste having low viscosity. Further, metallizations are applied to the surfaces other than the surface 4 of the main body of the dielectric block 2 by screen-printing. Then, these metallizations are sintered to complete the dielectric block 2. Since the metallizations applied to the surfaces other than the surface 4 of the main body of the dielectric block 2 are formed on the entirety of each surface, high accuracy is not required during the screen-printing. The forming of the metallizations on the main body of the dielectric block 2 is therefore easy to carry out.

Next, the metallizations 9-1, 9-2 and 11 are applied to the front surface 6 of the main body of the dielectric plate 3 by screen-printing and the metallizations 12-1, 12-2 and 14 are applied to the back surface 7 of the main body of the dielectric plate 3 by screen-printing. When applying the metallizations 9-1, 9-2 and 11 to the front surface 6 of the main body of the dielectric plate 3, the screen-printing can be performed with the back surface 7 of the main body of the dielectric plate 3 mounted on a stage (not shown) so the front surface 6 faces upward. When applying the metallizations 12-1, 12-2 and 14 to the back surface 7 of the main body of the dielectric plate 3, the screen-printing can be performed with the front surface 6 of the main body of the dielectric plate 3 mounted on the stage (not shown) so that the back surface 7 faces upward. As shown in FIG. 1, since the front surface 6 and the back surface 7 of the main body of the dielectric plate 3 have large areas compared with the edge surface 8, the dielectric plate 3 is in a very stable state when mounted on the stage (not shown) with the front surface 6 or the back surface 7 facing upward. The forming of the metallizations on the front surface 6 and the back surface 7 of the main body of the dielectric plate 3 is therefore relatively easy to carry out.

Further, the metallizations 15 are applied to the edge surface 8 of the main body of the dielectric plate 3 by transfer printing. Transfer printing is a method for forming metallization patterns corresponding to grooves on an object by preparing a rubber (not shown) having grooves corresponding to the patterns to be transferred, charging an Ag paste into the grooves and forcing the object onto the rubber. Although it is much easier to form metallizations by transfer printing than by screen-printing, it is impossible to form metallizations having accurate patterns by transfer printing. However, the accuracy of transfer printing is sufficient for forming the metallizations 15 on the edge surface 8 of the dielectric plate 3 because the metallizations 15 are only required to connect the metallizations formed on the dielectric block 2 and metallization 11 formed on the front surface 6 of the dielectric plate 3 while preventing the metallizations formed on the dielectric block 2 from connecting to the metallizations 9-1 and 9-2 formed on the front surface 6 of the dielectric plate 3. The forming of the metallizations on the edge surface 8 of the main body of the dielectric plate 3 is therefore also relatively easy to carry out. Then, these metallizations are sintered to complete the dielectric plate 3.

Next, the dielectric block 2 and the dielectric plate 3 formed by the above described method are joined as shown in FIG. 1(*b*) and, in this state, solder (not shown) is applied at the interface between the metallizations formed on the dielectric block 2 and the metallizations formed on the dielectric plate 3 to adhere them. Because these metallizations have a prescribed thickness, a gap corresponding to the thickness of the metallizations is formed between the surface 4 of the dielectric block 2 and the back surface 7 of the dielectric plate 3 at the portion where the metallizations 12-1, 12-2 and 14 are not formed. However, since the metallizations 14 are formed on a part of peripheral portion of the back surface 7 of the dielectric plate 3, the dielectric block 2 and the dielectric plate 3 are adhered at these portions. Therefore, the electrical and mechanical connection between the dielectric block 2 and the dielectric plate 3 can be surely established by providing the solder (not shown) to these portions. This completes the band pass filter 1.

As described above, the band pass filter 1 is made of the combination of the dielectric block 2, which can be fabricated merely by forming the metallizations on the whole of all surfaces except the surface 4, and the dielectric plate 3, which can be fabricated merely by forming the metallizations on both main surfaces (front surface 6 and back surface 7) and the edge surface of a single layered plate. Since the front surface 6 and the back surface 7 of the dielectric plate 3 have large areas compared with the edge surface 8, the dielectric plate 3 is in a very stable state when mounted on the stage (not shown) with the front surface 6 or the back surface 7 facing upward. The forming of the metallizations on the front surface 6 and the back surface 7 of the dielectric plate 3 is therefore relatively easy to carry out. Since it is thus relatively easy to fabricate the band pass filter 1 of this embodiment, the fabrication cost thereof can be lowered.

Further, the band pass filter 1 does not require formation of complex metallization patterns on the dielectric block 2 because the capacitance which is to be added to the resonators realized by the through holes 5 of the dielectric block 2 is formed by the metallizations 9-1 and 9-2 formed on the front surface 6 of the dielectric plate 3 and the metallizations 12-1 and 12-2 formed on the back surface 7 of the dielectric plate 3, and by the proximate portions 13 of the metallizations 12-1 and 12-2. Therefore, not only is fabrication of the dielectric block 2 very easy but band pass filters 1 having various characteristics can be obtained by joining dielectric plates 3 having different metallization patterns to the dielectric block 2. Because band pass filters 1 having various characteristics can be obtained by changing the metallization patterns formed on the dielectric plate 3, band pass filters 1 suitable for mass production can be provided.

Moreover, in the band pass filter 1, the metallizations formed on the back surface 7 of the dielectric plate 3 are positioned between the dielectric materials forming the dielectric block 2 and the dielectric plate 3 after the dielectric block 2 and the dielectric plate 3 are joined. Thus, the capacitance of the capacitor C2 formed by the proximate portions 13 of the metallizations 12-1 and 12-2 is larger than the capacitance obtained by forming the same metallization patterns on the surface 4 of the dielectric block 2. Therefore, a band pass filter that requires a large capacitance can be provided. On the other hand, in case of forming a band pass filter that does not require a large capacitance, because the distance (gap) between the proximate portions 13 of the metallizations 12-1 and 12-2 can be widened, design freedom is sufficiently ensured.

Next, a band pass filter according to another embodiment of the present invention will be explained.

Figure 4:
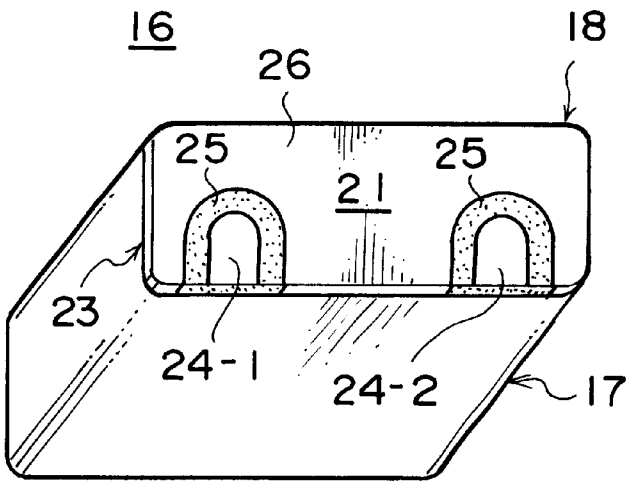
FIG. 4(*a*) is a perspective view showing a band pass filter 16 that is another preferred embodiment of the present invention with its components separated.
Figure 4:
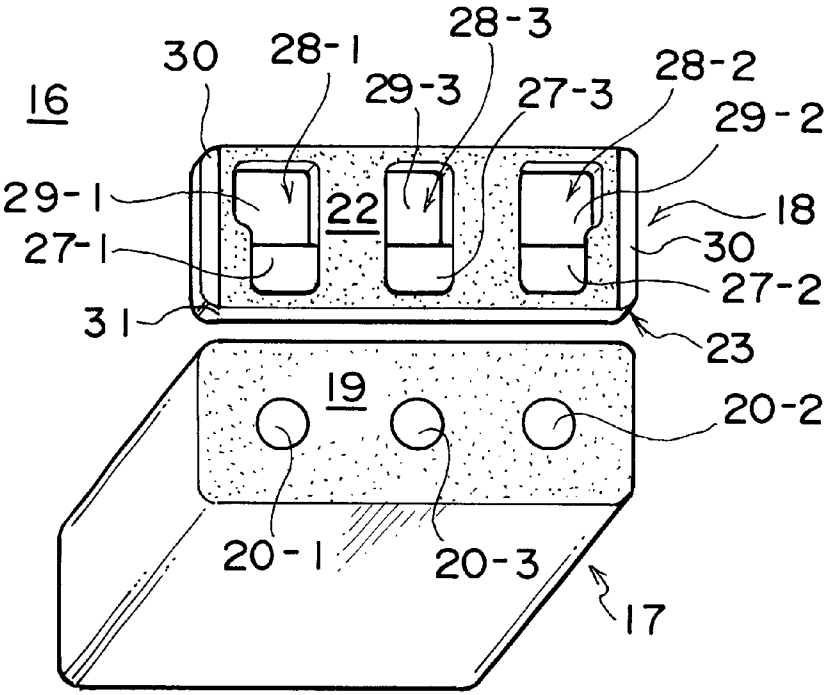

FIG. 4 is a perspective view showing a band pass filter 16 of this embodiment; FIG. 4(*a*) shows the components of the band pass filter in a separated state and FIG. 4(*b*) shows them in a joined state.

As shown in FIG. 4, the band pass filter 16 is constituted of a dielectric block 17 and a dielectric plate 18.

The dielectric block 16 has the shape of an almost rectangular prism measuring 10.0 mm×4.0 mm×7.3 mm and is made of a ceramic ($\epsilon r$=92) composed mainly of barium titanate. The dielectric block 17 has three through holes 20-1, 20-2 and 20-3 that are formed in parallel from a surface 19 to the opposite surface (not shown). The through holes 20-1, 20-2 and 20-3 are 1.4 mm in diameter. Further, all surfaces of the dielectric block 17 (including the inner walls of the through holes 20-1, 20-2 and 20-3) except the surface 19 are metallized and are grounded during mounting.

The dielectric plate 18 is a single layered plate measuring 10.0 mm×4.0 mm×0.6 mm made of a ceramic ($\epsilon r$=92) composed mainly of barium titanate, the same material as the dielectric block 17. The dielectric plate 18 has a surface (front surface) 21 which faces outward when the dielectric plate 18 is joined to the dielectric block 17, a surface (back surface) 22 which faces toward the surface 19 of the dielectric block 17 when the dielectric plate 18 is joined to the dielectric block 17, and, an edge surface 23. As shown in FIG. 4(*b*), metallizations 24-1 and 24-2 are formed on the front surface 21 at portions to be input/output terminals and a metallization 26 is formed on the entire front surface 21 except at clearance portions 25 located at the periphery of the metallizations 24-1 and 24-2. As shown in FIG. 4(*a*), metallizations 27-1, 27-2 and 27-3 are formed on the back surface 22 at portions corresponding to the three through holes 20-1, 20-2 and 20-3. When the dielectric plate 18 is joined to the dielectric block 17, the metallizations 27-1, 27-2 and 27-3 are directly in contact with the metallizations formed on the inner walls of the through holes 20-1, 20-2 and 20-3, respectively. Further, three cavities 28-1, 28-2 and 28-3 in which metallizations 29-1, 29-2 and 29-3 are formed on inner walls thereof are formed on the dielectric plate 18. These metallizations 29-1, 29-2 and 29-3 are in contact with the metallizations 27-1, 27-2 and 27-3, respectively. The metallizations 29-1 and 29-2 formed on the inner walls of the cavities 28-1 and 28-2 face the metallizations 24-1 and 24-2, respectively, formed on the front surface 21 of the dielectric plate 18 so as to form capacitors C4 and C5. Further, the metallization 29-3 formed on the inner wall of the cavity 28-3 faces the metallization 26 formed on the front surface 21 of the dielectric plate 18 so as to form a capacitor C6. Further, as shown in FIG. 4(*a*), metallizations 30 whose widths are 0.8 mm are formed on parts of the periphery of the back surface 22 of the dielectric plate 18. As shown in FIG. 4(*b*), metallizations 31 are formed on the whole of the edge surface 23 except at the portions in contact with the metallizations 24-1 and 24-2 and the clearance portions 25. A capacitor C7 is formed between the metallization 29-1 formed in the cavity 28-1 and the metallizations 31 formed on the side surfaces 23 and the metallization 26 formed on the front surfaces 21. A capacitor C8 is formed between the metallization 29-2 formed in the cavity 28-2 and the metallizations 31 formed on the side surfaces 23 and the metallization 26 formed on the front surfaces 21. As shown in FIG. 4(*a*), the cavities 28-1 and 28-2 have portions proximate to the edge surface 23 so as to enhance the capacitance of the capacitors C7 and C8.

The dielectric plate 18 having the above described structure is attached to the dielectric block 17 with its back surface 22 facing the surface 19 of the dielectric block 17 to complete the band pass filter 16 of this embodiment. Thus, the metallizations formed on the dielectric block 17 are connected to the metallization 26 formed on the front surface 21 of the dielectric plate 18 through the metallizations 30 formed on the back surface 22 of the dielectric plate 18 and the metallizations 31 formed on the edge surface 23 of the dielectric plate 18. As mentioned above, the metallizations 27-1, 27-2 and 27-3 formed on the back surface 22 of the dielectric plate 18 are in contact with the metallizations formed on the inner walls of the through holes 20-1, 20-2 and 20-3, respectively.

Figure 5:
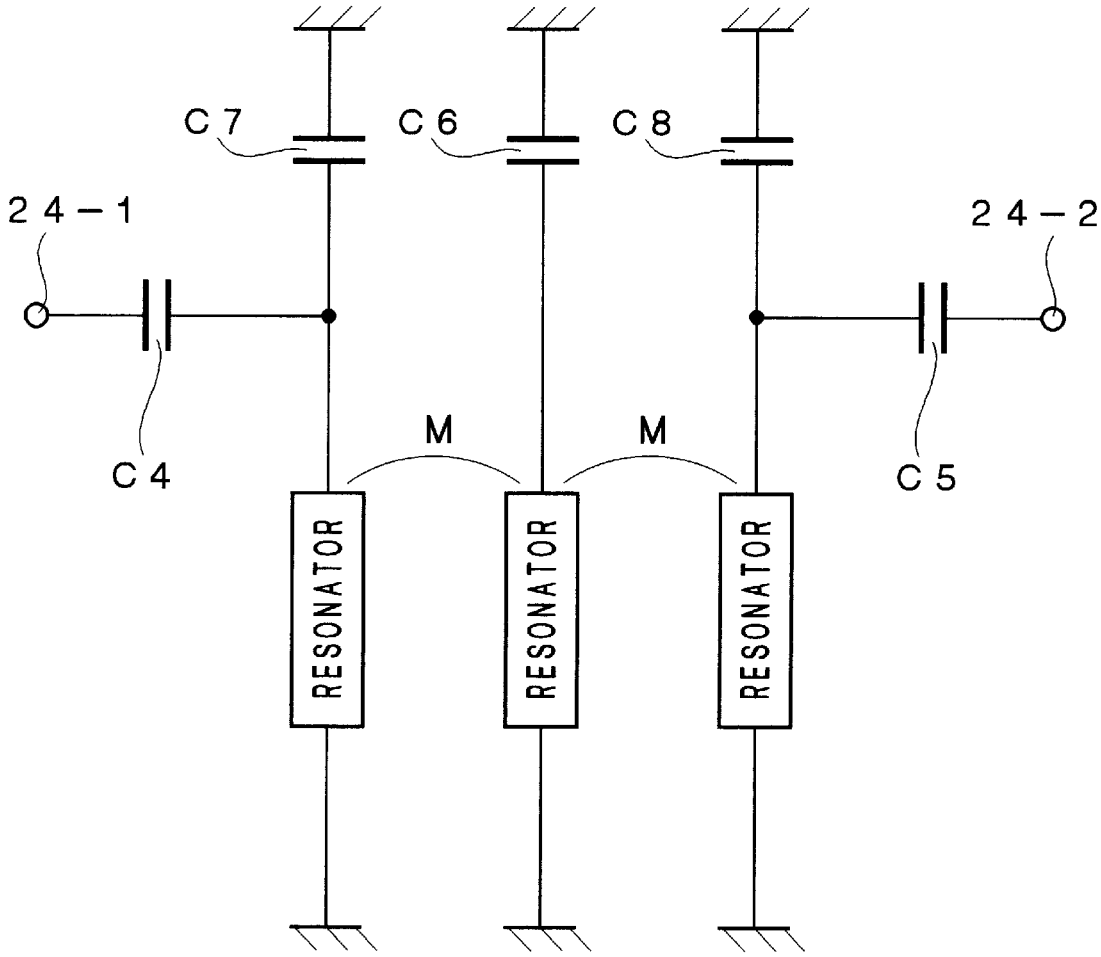
FIG. 5 is a circuit diagram of the band pass filter 16.

FIG. 5 is a circuit diagram of the band pass filter 16.

As shown in FIG. 5, the band pass filter 16 is constituted of the capacitor C4 having one node connected to the metallization 24-1, which is an input/output terminal; a first resonator and the capacitor C7 each connected between the other node of the capacitor C4 and ground; the capacitor C5 having one node connected to the metallization 24-2, which is an input/output terminal; a second resonator and the capacitor C8 each connected between the other node of the capacitor C5 and ground; a third resonator inductively coupled with the first and second resonators; and the capacitor C6 connected to the third resonator. One of the metallizations 24-1 and 24-2 is used as the input terminal and the other is used as the output terminal. Each of the first to third resonators is realized by the metallizations formed on the inner walls of the through holes 20-1, 20-2 and 20-3.

In the band pass filter 16 of this embodiment, the capacitors C4 to C6 formed by the metallizations 29-1, 29-2 and 29-3 have relatively large capacitance because they are formed on the inner walls of the cavities 28-1, 28-2 and 28-3 formed on the back surface 22 of the dielectric plate 18. Thus the capacitance produced between the metallizations 27-1 and 27-3 and the capacitance produced between the metallizations 27-2 and 27-3 are substantially negligible so that the coupling between the first and third resonators each realized by the metallizations formed on the inner walls of the through holes 20-1 and 20-3 and the coupling between the second and third resonators each realized by the metallizations formed on the inner walls of the through holes 20-2 and 20-3 become not capacitive but inductive.

Figure 6:
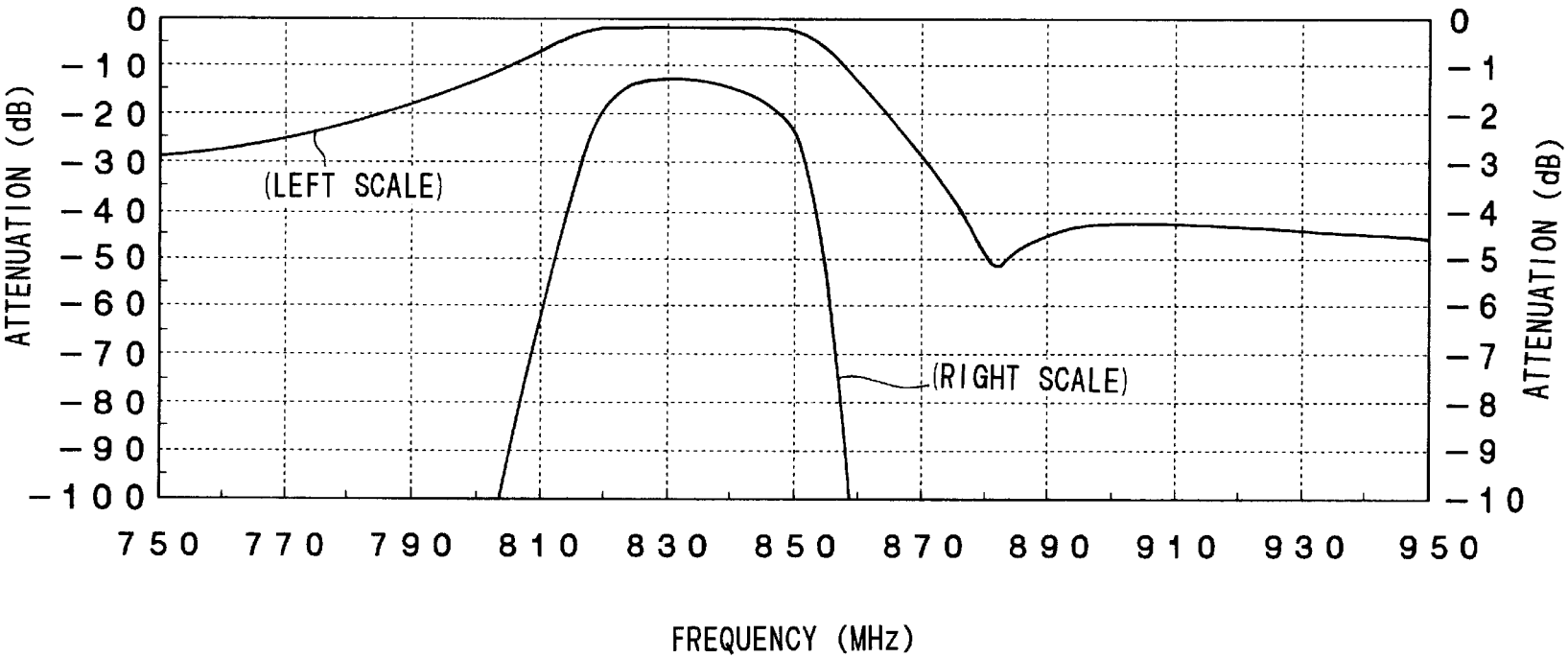
FIG. 6 is a graph showing the frequency characteristic curve of the band pass filter 16.

FIG. 6 is a graph showing the frequency characteristic curve of the band pass filter 16.

As shown in FIG. 6, the band pass filter 16 has a characteristic of passing a high frequency signal of approximately 820 MHz to 850 MHz and effectively eliminating a high frequency signal of approximately 870 MHz to 900 MHz. Therefore, the band pass filter 16 of this embodiment can be used as a component requiring such a frequency characteristic.

The frequency characteristic of the band pass filter 16 strongly depends on the patterns of the metallizations and the shapes of the cavities formed on the dielectric plate 18. Thus, a desired frequency characteristic can be given to the band pass filter 16 by varying the patterns of the metallizations and/or the shapes of the cavities formed on the dielectric plate 18.

Almost the same method can be used to fabricate the band pass filter 16 of this embodiment as that used for the band pass filter 1 explained earlier except that the cavities 28-1, 28-2 and 28-3 should be formed during the press molding of the main body of the dielectric plate 18.

To form the cavities 28-1, 28-2 and 28-3 on the main body of the dielectric plate 18, a die having convex portions corresponding to the cavities 28-1, 28-2 and 28-3 can be used during the press molding. It is easier to form the cavities on the main body of the dielectric plate 18 by press molding than it is to form cavities on the main body of the dielectric block. It is also easy to manufacture the die used therefor. This is because in case of forming cavities on the main body of the dielectric block, since the cavities should be formed on the surface at the portion where the through holes are to be formed, the die for the press molding would be complicated because a main die, the convex portions (sub die) to form the cavities and the rods disposed at almost center of the convex portions (sub die) to form the through holes are needed. Therefore, much time and expense would be required to manufacture the die and, in addition, the process of the press molding using such a die would be complicated. On the contrary, in case of forming cavities on the main body of the dielectric plate 18, since forming the convex portions to form the cavities is only required for the die, manufacturing the die is easy and, in addition, the process of the press molding using such a die is easy. Since, similarly to the case of the band pass filter 1, it is thus relatively easy to fabricate the band pass filter 16 of this embodiment, the fabrication cost thereof can be lowered.

Further, also in the band pass filter 16, complex metallization patterns do not have to be formed on the dielectric block. Therefore, not only is fabrication of the dielectric block 17 very easy but band pass filters 16 having various characteristics can be obtained by joining dielectric plates 18 having different metallization patterns and/or different cavity shapes to the dielectric block 17, so that band pass filters 16 suitable for mass production can be provided.

Next, the band pass filter according to a further embodiment of the present invention will be explained.

Figure 7:
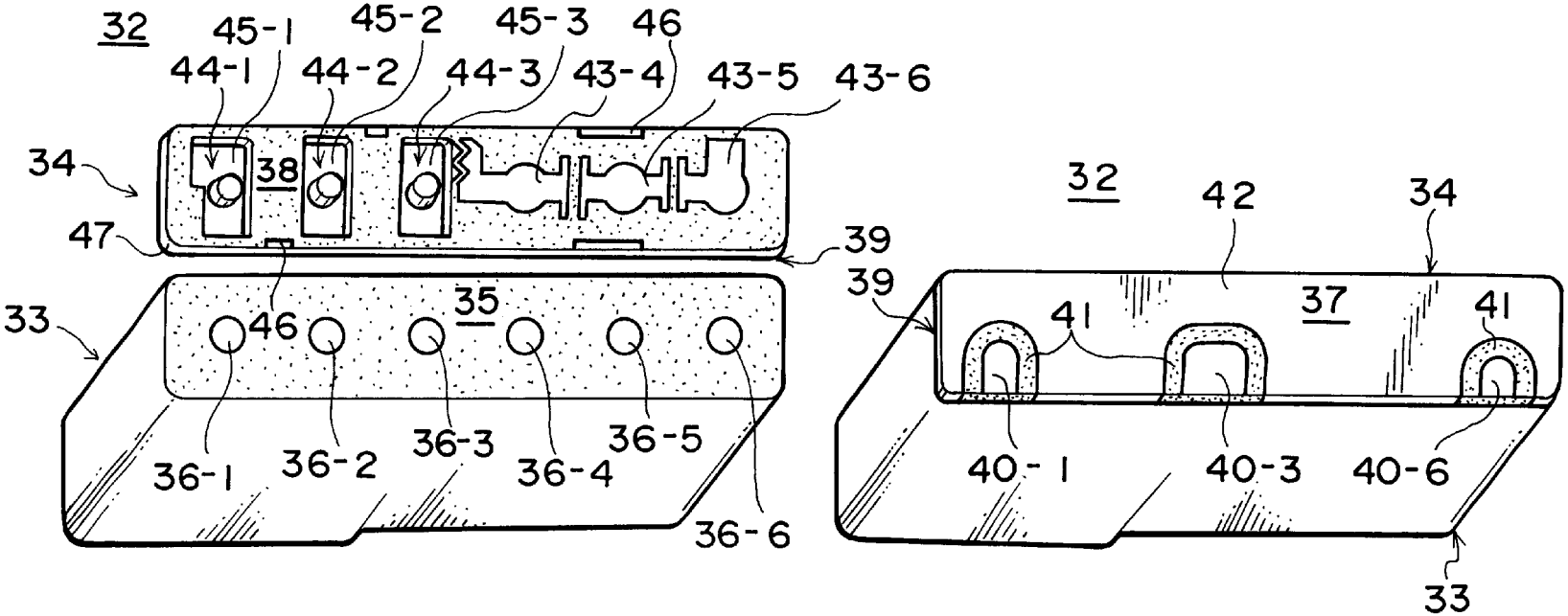
FIG. 7(*a*) is a perspective view showing a band pass filter 32 that is a further preferred embodiment of the present invention with its components separated.

FIG. 7 is a perspective view showing a band pass filter 32 of this embodiment; FIG. 7(*a*) shows the components of the band pass filter in a separated state and FIG. 7(*b*) shows them in a joined state.

As shown in FIG. 7, the band pass filter 32 is constituted of a dielectric block 33 and a dielectric plate 34.

The dielectric block 33 has the shape of an almost rectangular prism measuring 9.6 mm×2.5 mm×3.5 mm and is made of a ceramic ($\epsilon r$=92) composed mainly of barium titanate. The dielectric block 33 has six through holes 36-1 to 36-6 that are formed in parallel from a surface 35 to the opposite surface (not shown). The through holes 36-1 to 36-6 are 0.7 mm in diameter. Further, all surfaces of the dielectric block 33 (including the inner walls of the through holes 36-1 to 36-6) except the surface 35 are metallized and are grounded during mounting.

The dielectric plate 34 is a single layered plate measuring 9.6 mm×2.5 mm×0.6 mm and made from a ceramic ($\epsilon r$=92) composed mainly of barium titanate, the same material as the dielectric block 33. The dielectric plate 34 has a surface (front surface) 37 that faces outward when the dielectric plate 34 is joined to the dielectric block 33, a surface (back surface) 38 that faces the surface 35 of the dielectric block 33 when the dielectric plate 34 is joined to the dielectric block 33, and an edge surface 39. As shown in FIG. 7(*b*), metallizations 40-1, 40-3 and 40-6 are formed on the front surface 37 at portions to be a transmitter terminal TX (FIG. 8), an antenna terminal ANT and a receiver terminal RX, respectively, and a metallization 42 is formed on the entire front surface 37 except at clearance portions 41 located at the peripheries of the metallizations 40-1, 40-3 and 40-6. As shown in FIG. 7(*a*), cavities 44-1 to 44-3 in which metallizations 45-1 to 45-3 are formed on inner walls thereof are formed on the back surface 38 of the dielectric plate 34 at positions corresponding to the three through holes 36-1 to 36-3, respectively. Further, projections are formed at approximately the centers of these cavities 44-1 to 44-3. When the dielectric plate 34 is joined to the dielectric block 33, these projections are interfitted into the through holes 36-1 to 36-3 so that the metallizations 45-1 to 45-3 formed on the cavities 44-1 to 44-3 are directly in contact with the metallizations formed on the inner walls of the through holes 36-1 to 36-3, respectively. Metallizations 43-4 to 43-6 are formed on the back surface 38 at portions corresponding to the three through holes 36-4 to 36-6, respectively. When the dielectric plate 34 is joined to the dielectric block 33, the metallizations 43-4 to 43-6 are directly in contact with the metallizations formed on the inner walls of the through holes 36-4 to 36-6, respectively.

The metallization 45-1 formed in the cavity 44-1, the metallization 45-3 formed in the cavity 44-3 and the metallization 43-6 face the metallizations 40-1, 40-3 and 40-6, respectively, formed on the front surface 37 of the dielectric plate 34 so as to form capacitors. Further, as shown in FIG. 7(*a*), metallizations 46 are formed on a part of periphery of the back surface 38 of the dielectric plate 34. As shown in FIG. 7(*b*), metallizations 47 are formed on the whole of the edge surface 39 except at the portions in contact with the metallizations 40-1, 40-3 and 40-6 and the clearance portions 41.

As shown in FIG. 7(*a*), the proximate portions between the metallizations 45-3 and 43-4, the metallizations 43-4 and 43-5 and the metallizations 43-5 and 43-6 are formed so as to enhance the capacitance between these metallizations.

The dielectric plate 34 having the above described structure is attached to the dielectric block 33 with its back surface 38 facing the surface 35 of the dielectric block 33 to complete the band pass filter 32 of this embodiment.

Figure 8:
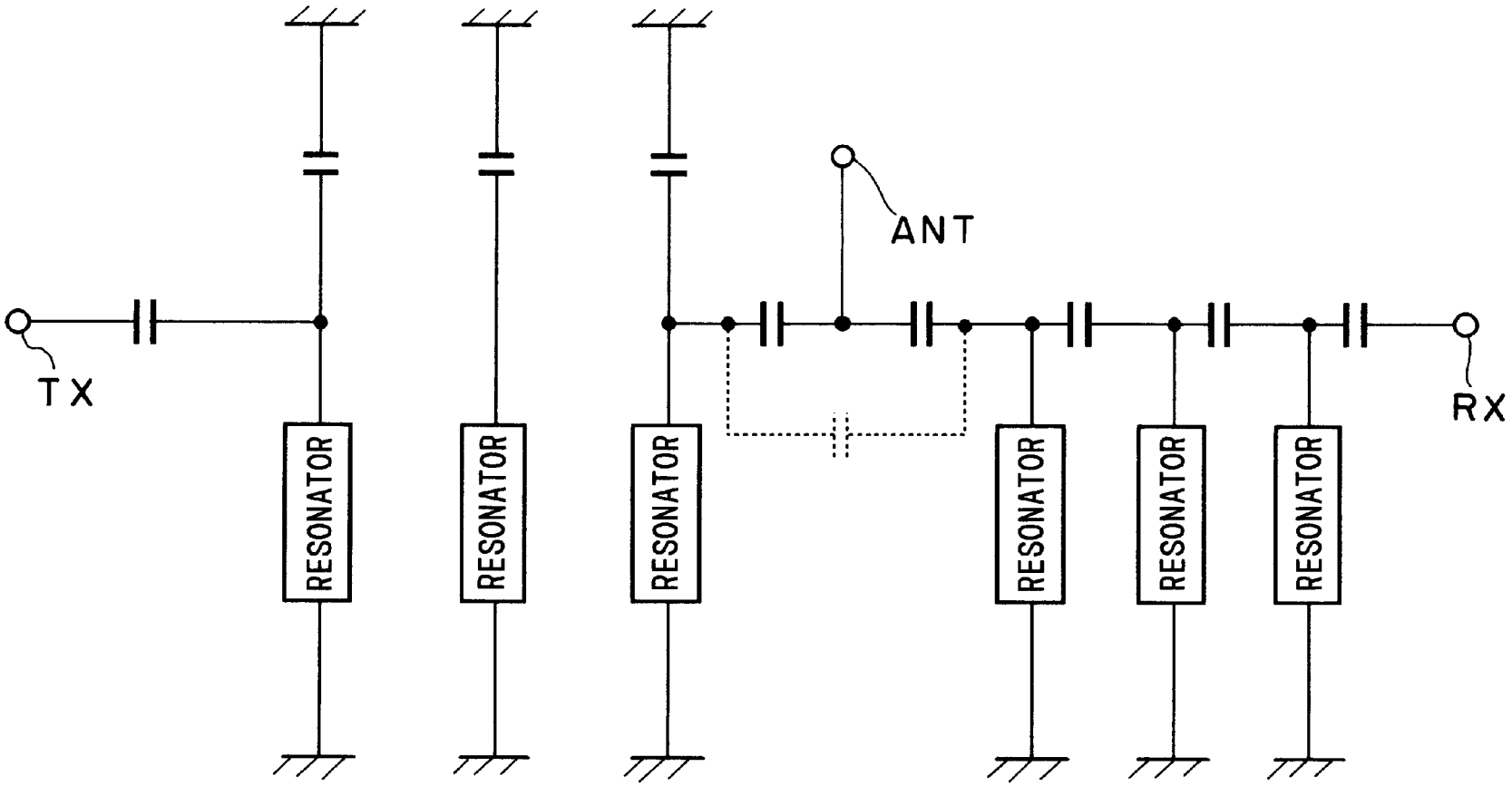
FIG. 8 is a circuit diagram of the band pass filter 32.

FIG. 8 is a circuit diagram of the band pass filter 32.

As shown in FIG. 8, the band pass filter 32 can be used as a so-called duplexer which works as a band pass filter having the antenna terminal ANT as an input terminal and the receiver terminal RX as an output terminal and works as a band pass filter having the transmitter terminal TX as an input terminal and the antenna terminal ANT as an output terminal.

Figure 9:
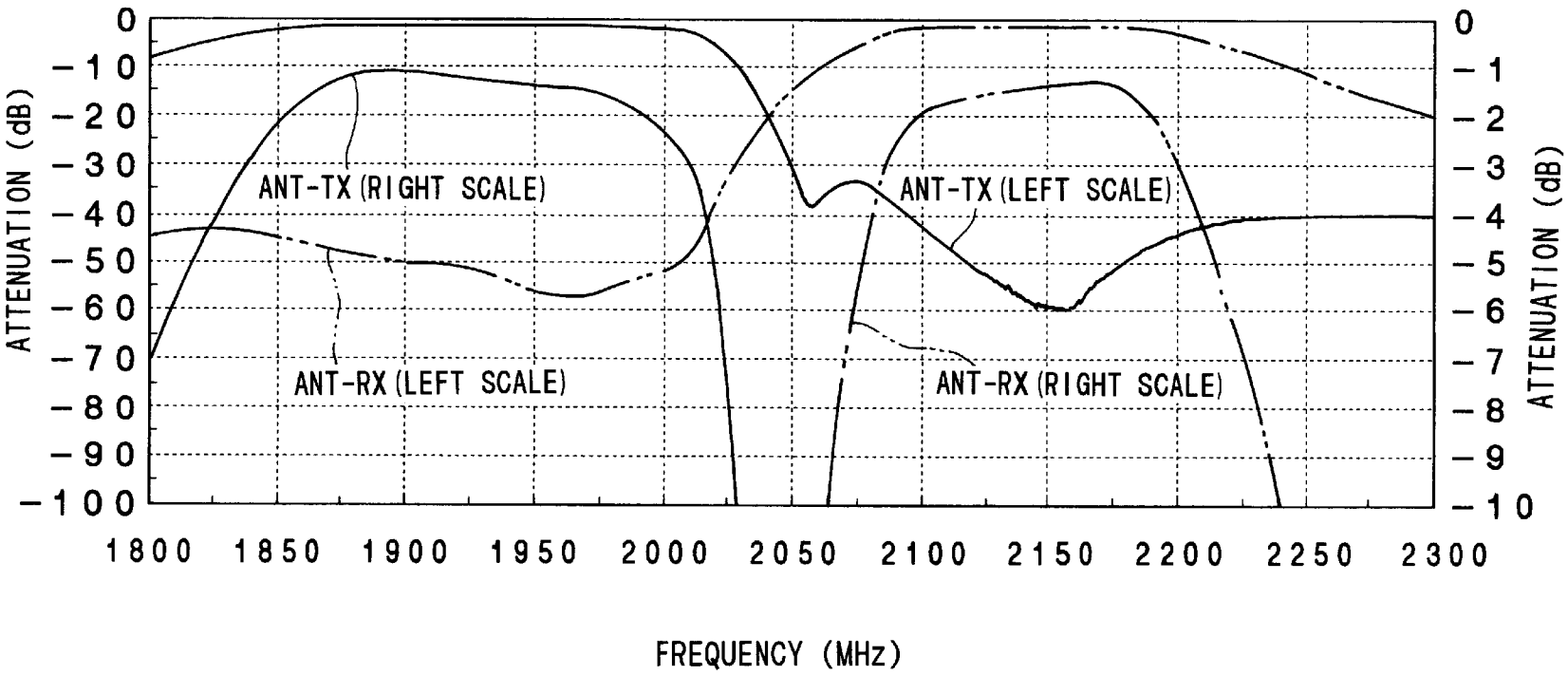
FIG. 9 is a graph showing the frequency characteristic curve of the band pass filter 32.

FIG. 9 is a graph showing the frequency characteristic curve of the band pass filter 32.

As shown in FIG. 9, the band pass filter 32 has a characteristic of passing a high frequency signal of approximately 2090 MHz to 2200 MHz and effectively eliminating a high frequency signal of lower than around 2000 MHz between the antenna terminal ANT and the receiver terminal RX; and a characteristic of passing a high frequency signal of approximately 1850 MHz to 2000 MHz and effectively eliminating a high frequency signal of higher than around 2050 MHz between the antenna terminal ANT and the transmitter terminal TX. Therefore, the band pass filter 32 of this embodiment can be used as a component requiring such a frequency characteristic.

The frequency characteristic of the band pass filter 32 strongly depends on the patterns of the metallizations and the shapes of the cavities formed on the dielectric plate 34. Thus, a desired frequency characteristic can be given to the band pass filter 32 by varying the patterns of the metallizations and/or the shapes of the cavities formed on the dielectric plate 34.

Almost the same method can be used to fabricate the band pass filter 32 of this embodiment as that used for the band pass filter 1 explained earlier except that the cavities 44-1, 44-2 and 44-3 should be formed during the press molding of the main body of the dielectric plate 34. Since, similarly to the case of the band pass filter 1, it is relatively easy to fabricate the band pass filter 32 of this embodiment, the fabrication cost thereof can be lowered.

Further, also in the band pass filter 32, complex metallization patterns do not have to be formed on the dielectric block 33. Therefore, not only is the fabrication of the dielectric block 33 very easy but band pass filters 32 having a various characteristics can be obtained by joining dielectric plates 34 having different metallization patterns and/or different cavity shapes to the dielectric block 33, so that band pass filters 32 suitable for mass production can be provided.

Next, the band pass filter according to a further embodiment of the present invention will be explained.

Figure 10B:
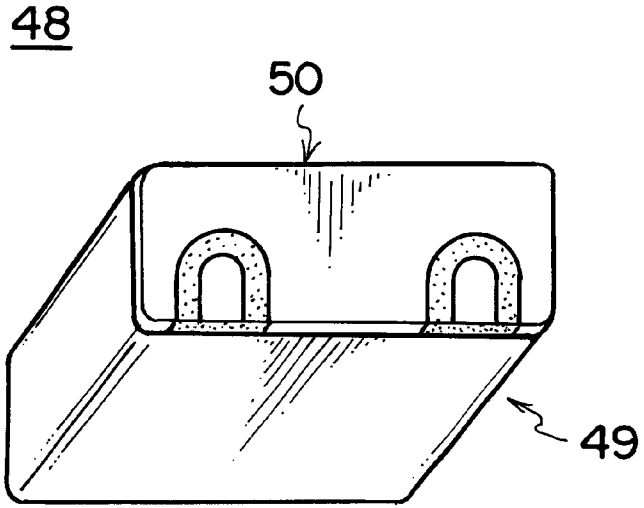
FIG. 10(*a*) is a perspective view showing a band pass filter 48 that is a further preferred embodiment of the present invention with its components separated.
Figure 10A:
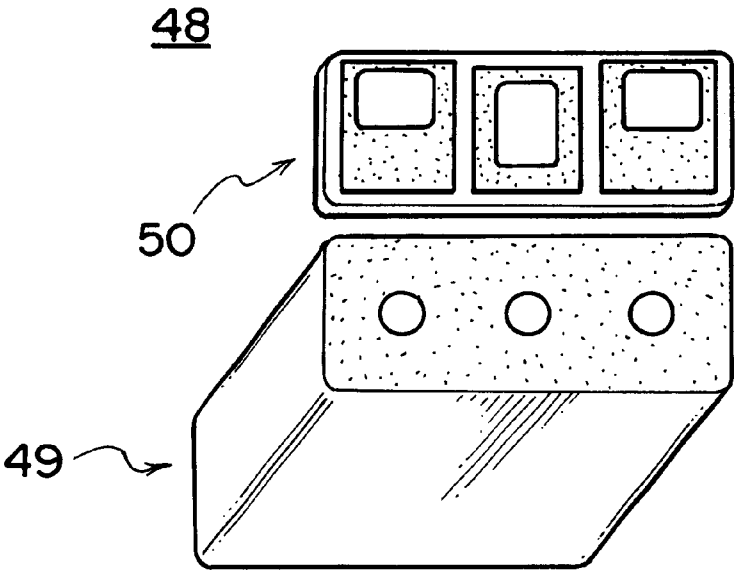

FIG. 10 is a perspective view showing a band pass filter 48 of this embodiment; FIG. 10(*a*) shows the components of the band pass filter in a separated state and FIG. 10(*b*) shows them in a joined state.

As shown in FIG. 10, the band pass filter 48 is constituted of a dielectric block 49 and a dielectric plate 50.

Although the band pass filter 48 of this embodiment cannot achieve as wide a pass band as that of the band pass filter 16, it can provide characteristics similar to those of the band pass filter 16 without forming the cavities 28-1, 28-2 and 28-3.

In the band pass filter 48 of this embodiment, since, as in the case of the band pass filter 1 explained earlier, no cavities are formed on the dielectric plate 50, it can be fabricated by easier processes. Further, in the band pass filter 48 of this embodiment, since metallization is formed on of the whole periphery of the back surface of the dielectric plate 50, the gap between the dielectric block 49 and the dielectric plate 50 is covered with this metallization when the dielectric plate 50 is joined to the dielectric block 49. Contamination by foreign matter entering into the gap is therefore prevented.

Next, the band pass filter according to a further embodiment of the present invention will be explained.

Figure 11:
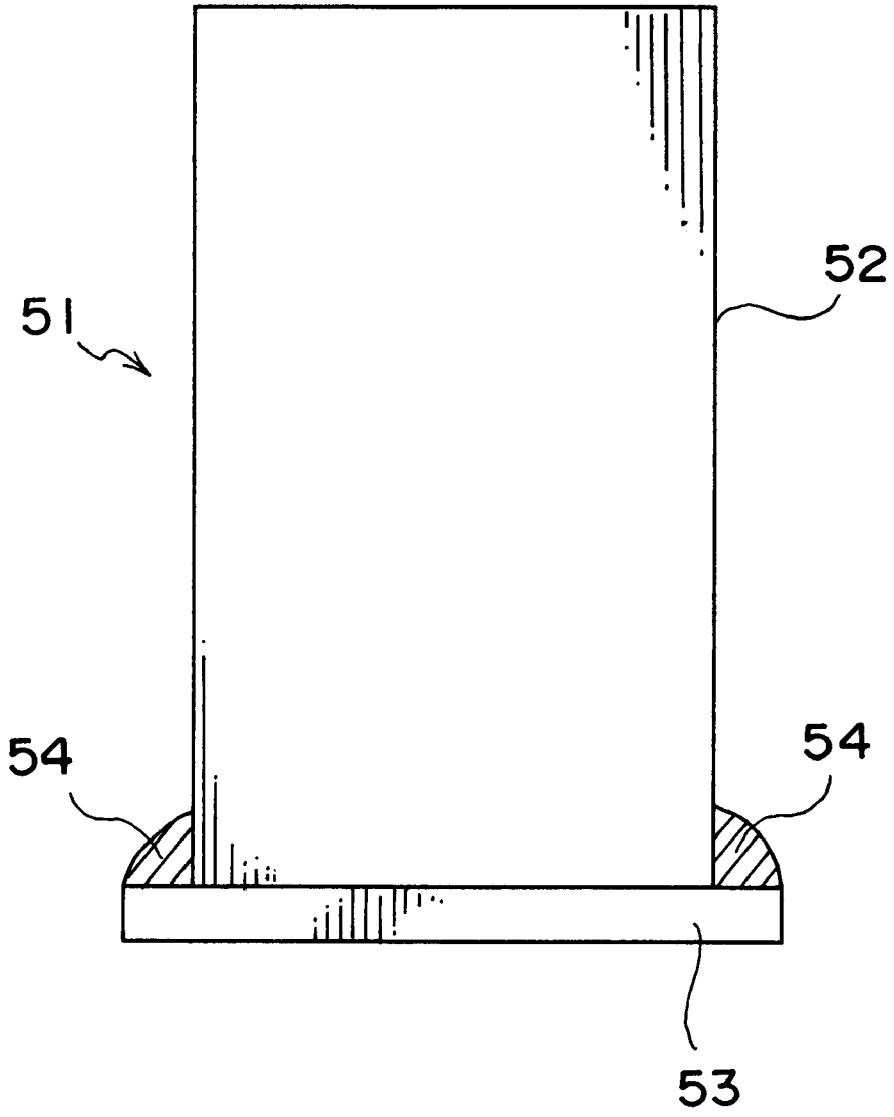
FIG. 11 is a schematic plan view showing a band pass filter 51 that is a further preferred embodiment of the present invention.

FIG. 11 is a schematic plan view showing a band pass filter 51 that is a further preferred embodiment of the present invention.

As shown in FIG. 11, the band pass filter 51 of this embodiment is constituted of a dielectric block 52 and a dielectric plate 53. The dielectric block 52 has the same structure as the dielectric block 2, 17, 33 or 49 of the band pass filter 1, 16, 32 or 48. On the other hand, although the dielectric plate 53 has the same structure as the dielectric plate 3, 18, 34 or 50 of the band pass filter 1, 16, 32 or 48, its size in plan view is a little larger than that of the dielectric block 52. Metallizations (not shown) are formed on the periphery of the back surface (the surface facing the dielectric block 52) of the dielectric plate 53.

In the band pass filter 51 of this embodiment, the dielectric block 52 and the dielectric plate 53 whose size in plan view is larger than that of the dielectric block 52 are used and are fixed by solder 54 applied to the portion of the back surface of the dielectric plate 53 not covered with the dielectric block 52 and a part of the side surface of the dielectric block 52.

According to the band pass filter 51 of this embodiment, the dielectric plate 53 and the dielectric block 52 can be strongly fixed because the solder 54 is provided over a wide area of the dielectric block 52 and the dielectric plate 53.

The present invention has thus been shown and described with reference to specific embodiments. However, it should be noted that the present invention is in no way limited to the details of the described arrangements but changes and modifications may be made without departing from the scope of the appended claims.

For example, in the band pass filters 1, 16, 32 and 48 of the above described embodiments, solder is used to adhere the dielectric plates 3, 18, 34 and 50 to the dielectric blocks 2, 17, 33 and 49. However the dielectric plates 3, 18, 34 and 50 can be joined to the dielectric blocks 2, 17, 33 and 49 prior to the sintering of the Ag paste and sintering then be performed to adhere them to each other. In this case, a soldering process for the dielectric blocks 2, 17, 33 and 49 and the dielectric plates 3, 18, 34 and 50 is not necessary. According to this method, because solder is not used, lead (Pb) free soldering that should be performed at higher temperature than ordinary can be applied when the band pass filter is mounted.

Further, in the band pass filters 1, 16, 32 and 48 of the above described embodiments, a ceramic composed mainly of barium titanate is used as the material of the dielectric blocks 2, 17, 33 and 49 and the dielectric plates 3, 18, 34 and 50. However the present invention is not limited to use of this material and dielectric blocks and dielectric plates can instead be made of any of various other materials such as ceramic of barium oxide type.

Moreover, in the band pass filters 1, 16, 32 and 48 of the above described embodiments, the capacitances are obtained by the metallization patterns formed on the dielectric plates 3, 18, 34 and 50. However, metallization patterns which work as other elements such as inductors or elements controlling the phase of input/output signals can be formed on the dielectric plates 3, 18, 34 and 50 according to the desired electrical characteristics.

Further, in the band pass filters 1, 16, 32 and 48 of the above described embodiments, the dielectric plates 3, 18, 34 and 50 are joined to the dielectric blocks 2, 17, 33 and 49 after the metallizing has been completed. However, insofar as at least the processes for the back surface of the dielectric plates 3, 18, 34 and 50 (forming the cavities and metallizations) have been finished, they can be joined at anytime and the metallizing be performed at the other portions thereafter.

Moreover, in the band pass filters 1, 16, 32 and 48 of the above described embodiments, although screen-printing is used to form the metallizations on the surfaces of the dielectric blocks 2, 17, 33 and 49 (excluding the inner walls of the through holes), the present invention is not limited to this method and any of various other methods can be used instead to form the metallizations. For example, it is possible to form the metallizations on the surfaces of the dielectric blocks 2, 17, 33 and 49 by spraying Ag paste onto the surfaces of the dielectric blocks 2, 17, 33 and 49 or pressing a sponge impregnated with Ag paste thereon.

Further, in the band pass filters 1, 16, 32 and 48 of the above described embodiments, although the metallizations are formed on inner walls of the through holes of the dielectric blocks 2, 17, 33 and 49 by introducing Ag paste having low viscosity, the present invention is not limited to this method and any of various other methods can be used to form the metallizations. For example, it is possible to form the metallizations on the inner walls of the through holes of the dielectric blocks 2, 17, 33 and 49 by introducing the Ag paste from one openings of the through holes while the other openings are vacuumed.

Moreover, in the band pass filters 1, 16, 32 and 48 of the above described embodiments, although screen-printing is used to form the metallizations on the back surfaces of the dielectric plates 3, 18, 34 and 50, the present invention is not limited to this method and any of various other methods can be used instead to form the metallizations so as long as pattern accuracy can be ensured.

Further, in the band pass filters 1, 16, 32 and 48 of the above described embodiments, although transfer printing is used to form the metallizations on the side surfaces of the dielectric plates 3, 18, 34 and 50, the present invention is not limited to this method and any of various other methods can be used instead to form the metallizations.

Moreover, in the band pass filters 1, 16, 32 and 48 of the above described embodiments, although Ag paste is used as the material of the metallizations, the present invention is not limited to use of Ag paste and any of various other conductive materials, copper (coppering), for example, can be used instead. In case of using coppering as the material of the metallizations, the copper plating can be performed with a resist formed on the portion where the metallizations should not be formed (certain surfaces of the dielectric blocks 2, 17, 33 and 49) in advance. It is preferable to use an electroless plating.

Further, in the band pass filters 16 and 32 of the above described embodiments, it is preferable for the walls of the cavities 28-1 to 28-3 and 44-1 to 44-3 formed on the back surfaces 22 and 38 of the dielectric plates 18 and 34 not to be perpendicular to the back surfaces 22 and 38 of the dielectric plates 18 and 34 but to be tapered at a predetermined angle. In the case where the walls of the cavities are tapered, while the convex portions of the die for the press molding must also be tapered, a die having tapered convex portions has the advantage of enhanced working efficiency because the die and the dielectric plate are easy to separate.

Moreover, in the band pass filter 32 of the above described embodiment, three cavities 44-1 to 44-3 are formed on the dielectric plate 34 and the metallizations 45-1 to 45-3 are formed on the inner walls of the cavities 44-1 to 44-3. However, it is alternatively possible to form the metallizations in a manner similar to the metallizations on the dielectric plate 50 of the band pass filter 48 as shown in FIG. 10, without forming the cavities 44-1 to 44-3 on the dielectric plate 34.

Further, in the band pass filter 51 of the above described embodiment, although the area of the dielectric plate 53 is made larger than the area of the dielectric block 52, the area of the dielectric block 52 can instead be made larger than the area of the dielectric plate 53. In this case, the metallizations formed on the side surfaces of the dielectric block 52 and the metallizations formed on the edge surface of the dielectric plate 53 should be electrically and mechanically connected by providing Ag paste on the exposed portion of the surface of the dielectric block 52 not covered with the dielectric plate 53 using a syringe or the like.

As described above, according to the present invention, a compact band pass filter that can be fabricated at low cost can be provided.

What is claimed is:

1. A band pass filter comprising a dielectric block having through holes formed from one surface thereof to another surface opposite to the one surface and a single layered dielectric plate having a front surface and a back surface coupled to the dielectric block such that the back surface faces and directly joins the one surface of the dielectric block, the dielectric block having metallizations formed on all surfaces except the one surface, the dielectric plate having metallizations of predetermined patterns formed on the front and the back surfaces, and the dielectric block and the dielectric plate being made from the same kind of a ceramic material, wherein the dielectric plate has cavities formed on the back surface thereof and the metallizations are formed on inner walls of the cavities.

2. The band pass filter as claimed in claim 1, wherein the metallizations formed on the front and back surfaces of the dielectric plate respectively form front surface electrodes and back surface electrodes of capacitors.

3. The band pass filter as claimed in claim 1, wherein the metallizations formed on the back surface of the dielectric plate are in contact with the metallizations formed on inner walls of the through holes.

4. The band pass filter as claimed in claim 1, wherein the dielectric plate has metallized projections projecting from the cavities, the metallizations formed on the projections being in contact with the metallizations formed on inner walls of the through holes.

5. The band pass filter as claimed in claim 1, wherein the through holes include at least a first through hole and a second through hole, the metallizations formed on the front surface of the dielectric plate include at least a first pattern and a second pattern, and the metallizations formed on the back surface of the dielectric plate include at least a third pattern and a fourth pattern, a first capacitor being formed by the first and third patterns, a second capacitor being formed by the second and fourth patterns, and the third and fourth patterns being in contact with the metallizations formed on inner walls of the first and second through holes, respectively.

6. The band pass filter as claimed in claim 5, wherein the first and second patterns are an input terminal and an output terminal, respectively.

7. The band pass filter as claimed in claim 1, wherein the dielectric block and the dielectric plate are fixed by solder.

8. The band pass filter as claimed in claim 1, wherein every metallization is made of a conductive paste, and the dielectric block and the dielectric plate are fixed by sintering the conductive paste with the dielectric block and the dielectric plate joined.

9. The band pass filter as claimed in claim 1, wherein the back surface of the dielectric plate has a different surface area from that of the one surface of the dielectric block.

10. A band pass filter comprising a single dielectric block having a plurality of through holes formed from one surface thereof to another surface opposite to the one surface and a single layered dielectric plate having a front surface and a back surface coupled to the dielectric block such that the back surface faces and directly joins the one surface of the dielectric block, the dielectric block having metallizations formed on surfaces except the one surface; thereby the one surface is entirely exposed without being covered with any metallizations, and the dielectric plate having metallizations of predetermined patterns formed on the front and the back surfaces.

11. The band pass filter as claimed in claim 10, wherein the dielectric plate has cavities formed on the back surface thereof and the metallizations are formed on inner walls of the cavities.

12. The band pass filter as claimed in claim 11, wherein the dielectric plate has metallized projections projecting from the cavities, the metallizations formed on the projections being in contact with the metallizations formed on inner walls of the through holes.

13. The band pass filter as claimed in claim 10, wherein the through holes include at least a first through hole and a second through hole, the metallizations formed on the front surface of the dielectric plate include at least a first pattern and a second pattern, and the metallizations formed on the back surface of the dielectric plate include at least a third pattern and a fourth pattern, a first capacitor being formed by the first and third patterns, a second capacitor being formed by the second and fourth patterns, and the third and fourth patterns being in contact with the metallizations formed on the inner walls of the first and second through holes, respectively.

14. The band pass filter as claimed in claim 13, wherein the first and second patterns are an input terminal and an output terminal, respectively.

15. The band pass filter as claimed in claim 10, wherein the dielectric block and the dielectric plate are made from the same kind of a ceramic material.

16. The band pass filter as claimed in claim 10, wherein the back surface of the dielectric plate and the one surface of the dielectric block are substantially the same dimension thereby the band pass filter has the shape of an almost rectangular prism.

* * * * *

UNITED STATES PATENT AND TRADEMARK OFFICE

CERTIFICATE OF CORRECTION

PATENT NO. : 6,570,473 B2 
DATED : May 27, 2003
INVENTOR(S) : Kenji Endo and Osamu Takubo It is certified that error appears in the above-identified patent and that said Letters Patent is hereby corrected as shown below:

Title page,
Item [73], Assignee, change "TKD" to -- TDK --.

Column 4,
Lines 25 and 37, before and after the symbol "x" insert a space.

Column 5,
Lines 54, 55, 56 and 57, before and after the symbol "x" insert a space.

Column 7,
Line 57, before and after the symbol "x" insert a space.

Column 8,
Line 2, before and after the symbol "x" insert a space.

Column 10,
Lines 23 and 33, before and after the symbol "x" insert a space.

Signed and Sealed this

Twenty-third Day of September, 2003

JAMES E. ROGAN
*Director of the United States Patent and Trademark Office*